US007565971B2

(12) United States Patent
Jenkins et al.

(10) Patent No.: US 7,565,971 B2
(45) Date of Patent: Jul. 28, 2009

(54) PACKAGE OF SPECIALTY ROOFING MATERIALS, INSERT THEREFORE AND METHOD OF PACKAGING

(75) Inventors: Robert L. Jenkins, Honey Brook, PA (US); Anna Amatruda, Norristown, PA (US)

(73) Assignee: CertainTeed Corporation, Valley Forge, PA (US)

( * ) Notice: Subject to any disclaimer, the term of this patent is extended or adjusted under 35 U.S.C. 154(b) by 477 days.

(21) Appl. No.: 11/383,507

(22) Filed: May 16, 2006

(65) Prior Publication Data

US 2007/0267306 A1 Nov. 22, 2007

(51) Int. Cl.

| | |
|---|---|
| ***B65D 85/46*** | (2006.01) |
| ***B65D 85/62*** | (2006.01) |
| ***B65D 81/02*** | (2006.01) |
| ***B65B 5/10*** | (2006.01) |

(52) U.S. Cl. ..... 206/323; 53/475; 206/499; 206/523; 206/584

(58) Field of Classification Search ..... 206/323–324, 206/449–456, 499, 521, 523, 584; 53/397, 53/429, 447, 473–475

See application file for complete search history.

(56) References Cited

U.S. PATENT DOCUMENTS

| | | | | |
|---|---|---|---|---|
| 1,716,783 | A * | 6/1929 | Latimer | 53/473 |
| 2,133,683 | A * | 10/1938 | Black | 206/323 |
| 2,346,450 | A * | 4/1944 | Owen | 206/323 |
| 3,239,992 | A * | 3/1966 | Hodgson | 53/397 |
| 3,596,798 | A * | 8/1971 | Smith | 206/449 |
| 4,714,643 | A * | 12/1987 | Kuenzel | 206/499 |
| 5,615,767 | A * | 4/1997 | Eull et al. | 206/499 |
| 6,367,627 | B2 | 4/2002 | Freiborg et al. | |
| 6,547,126 | B2 | 4/2003 | Freiborg et al. | |

* cited by examiner

*Primary Examiner*—Bryon P Gehman
(74) *Attorney, Agent, or Firm*—Paul & Paul

(57) ABSTRACT

A package is provided, of specialty roofing materials, including a plurality of stacked shingles in the package, in nested relation, with the shingles being of variable thickness from one end to the other in one or more stacks, as packaged, to be of "V" configuration, and of various selected orientations, and forming a substantially hollow zone, with at least one insert structure to fill the hollow zone and provide support for the end shingle in the stack. The at least one insert structure may be constructed of various materials, such as folded cardboard, cellular foam or the like. Filler material may be provided in the package, for any voids between the stack of shingles and the upper end of the package.

18 Claims, 10 Drawing Sheets

PACKAGE OF SPECIALTY ROOFING MATERIALS, INSERT THEREFORE AND METHOD OF PACKAGING

BACKGROUND OF THE INVENTION

It has been known to package specialty roofing materials, such as shingles of the hip, ridge and/or rake types in pre-folded or pre-bent form, such that the shingles may more readily be installed on a roof, without having to fold or bend them in situ, perhaps at temperatures that may induce cracking upon the bending or folding of them in situ. Because the shingles are already folded into a "V"-shape (or inverted "V"-shape) the installation of these shingles on a roof can be more efficiently and more effectively accomplished.

Examples of the packaging of shingles in accordance with prior art techniques are set forth, for example, in U.S. Pat. Nos. 6,367,627 and 6,547,126.

SUMMARY OF INVENTION

The present invention is directed to packaging specialty roofing materials of the shingle type, wherein the shingles are to be installed on a hip, ridge or rake of a roof, for example, such that their leading edges will be visible when installed, and their trailing edges will be covered by the leading edges of next overlying-shingles, and most particularly, when the leading edges of the shingles are thicker and the trailing or covered-when-installed edges of the shingles are thinner, so that each such shingle varies in thickness from one edge to another. Also, in accordance with the present invention, the package of shingles is comprised of pre-folded shingles, folded along a common longitudinally disposed connecting line, such that there are two panel portions comprising angular planes that intersect to define a "V" configuration of some selected orientation, such as vertical, inverted, sideways oriented, etc., and wherein the panel portions of the shingle define a hollow zone in the "V"-shaped configuration.

In accordance with the present invention, there is provided an insert structure for disposition into the hollow zone of the "V"-shaped configuration. The insert structure has spaced-apart ends and is of generally triangular configuration in the transverse direction and is provided with supporting surface legs to engage against the panel portions of an endmost shingle in the hollow zone therebetween.

The insert structure provides support for maintaining the shape of the insert. Such support can take any of various forms, such as being a triangular support that is connected to the planar surface legs of the support at spaced-apart opposite ends; it can take the shape of a support that is interior of the insert structure for supporting the planar surface legs of the insert structure; it can take the shape of a supporting planar surface that connects the generally planar surface legs to comprise a third planar surface leg; or it can comprise a substantially solid three-dimensional support such as cellular foam or the like that is placed in the hollow zone of the endmost shingle.

In accordance with the present invention, the insert can be used to support shingles in a stack, that are laid in alternating relationship in the stack, with at one end of the stack, some shingles having thicker edges, and at that same end of the stack, some shingles can have thinner edges, alternating in such manner in the stack.

Furthermore, the package of shingles can have an insert that is in the shape of a longitudinal prism, or a longitudinal prismoid between its spaced apart ends, as may be desired.

The insert for the package can be of folded cardboard or like construction, or of cellular foam construction, as may be desired. Alternatively, the insert can be of molded plastic construction.

In the package of shingles, there may be spaces above the shingles in the stack, that can be filled with an additional insert structure, which may or may not be comprised of the primary insert structure that is severed into a pair of smaller insert structures.

The package in accordance with this invention may comprise a plurality of side-by-side stacks of shingles with their insert structures, or a plurality of longitudinally arranged, end-to-end stacks of shingles with their insert structures.

The insert structure itself in accordance with this invention may be as described above, in any of its various forms, or perhaps other, equivalent forms.

Accordingly, it is an object of this invention to provide a novel package of specialty roofing materials comprising a plurality of shingles arranged in a stack, with at least one insert structure, and a package therefor.

It is a further object of this invention to provide a novel insert structure for a package of shingles.

Other objects and advantages of the present invention will become readily apparent upon a reading of the following brief descriptions of the drawing figures, the detailed descriptions of the preferred embodiments, and the appended claims.

BRIEF DESCRIPTION OF THE DRAWING FIGURES

Figure 1:
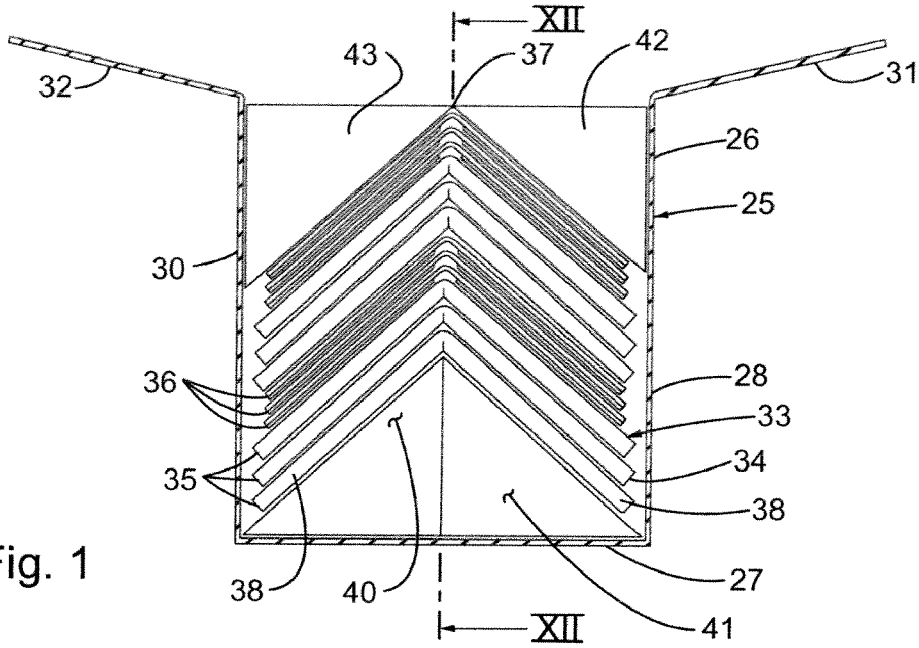
FIG. 1 is a vertical sectional view through a container in accordance with this invention, illustrating an end view of a stack of shingles therein, with a supporting insert structure at the lower end of the stack, and with smaller upper insert structures above the stack of shingles in the container, filling the space at the upper end of the container above the stack.
Figure 10:
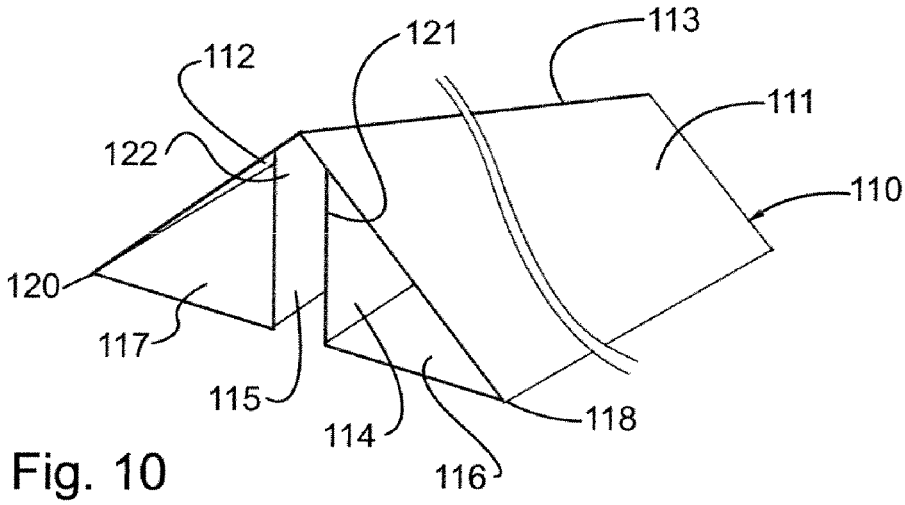
FIG. 10 is a perspective view of a further modified or alternative form of insert structure in accordance with this invention.
Figure 12:
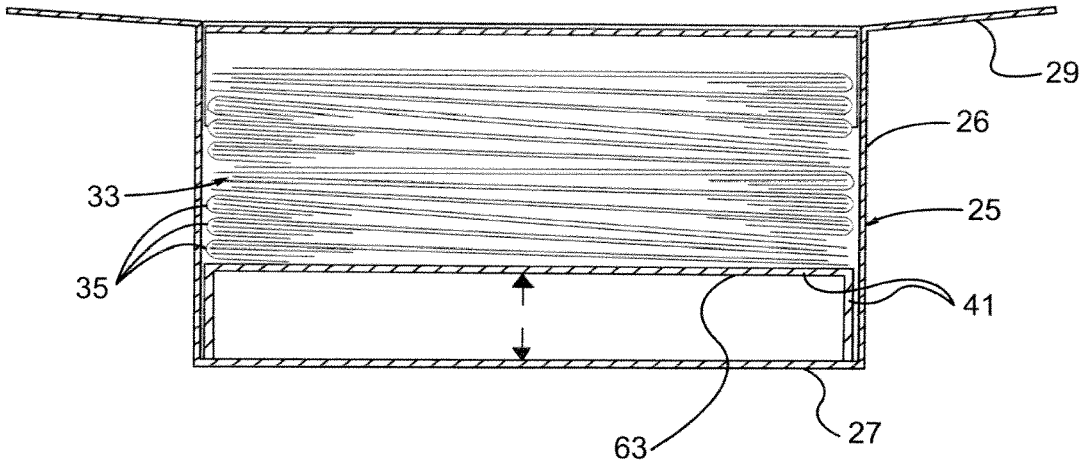

FIG. 12 is a longitudinal sectional view, through the container, stack of shingles, and insert structures in accordance with this invention, taken generally along the line XII-XII of FIG. 1, and wherein the bottom insert structure is of uniform shape along its length, irrespective of wherever a transverse section might be taken, such that the insert structure of FIG. 10 is in the form of a three-sided prism.

Figure 13:
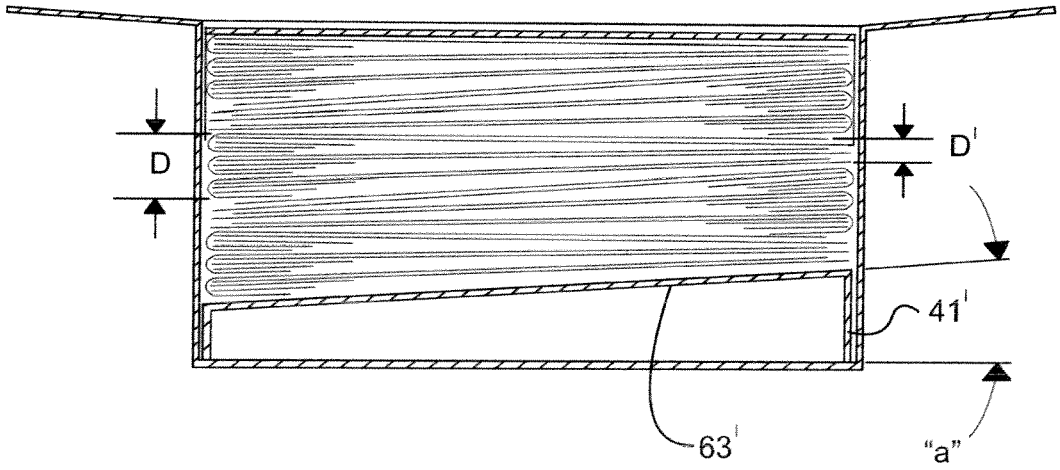

FIG. 13 is an illustration similar to that of FIG. 12, but wherein the insert structure varies in transverse size longitudinally from end-to-end, and is in the form of a prismoid.

Figure 14:
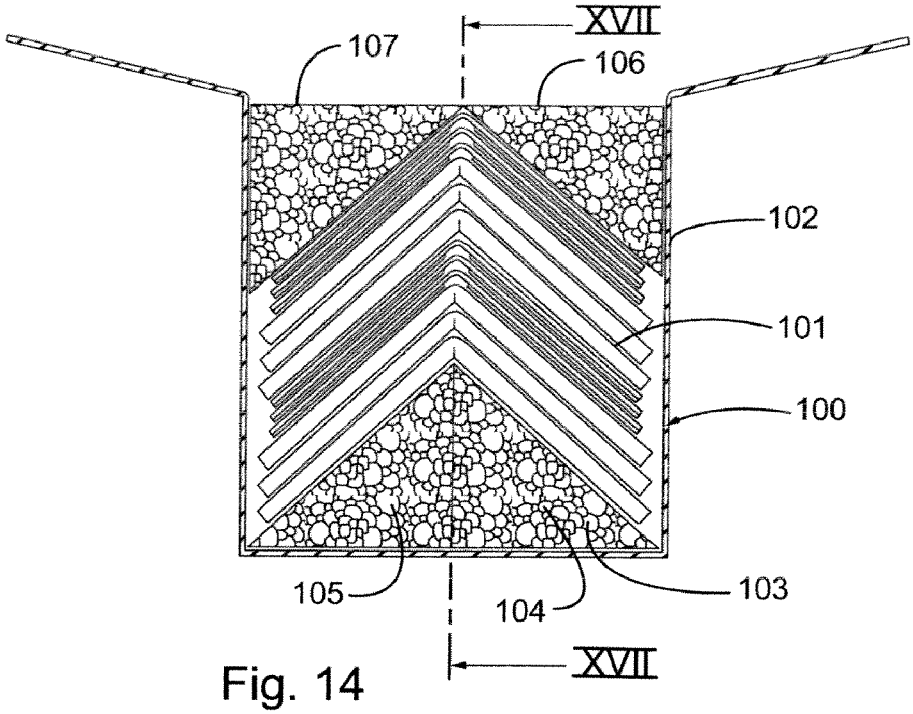

FIG. 14 is an illustration of a container, stack of shingles, and insert structures, similar to that of FIG. 1, but wherein the insert structures are of cellular foam construction.

Figure 2:
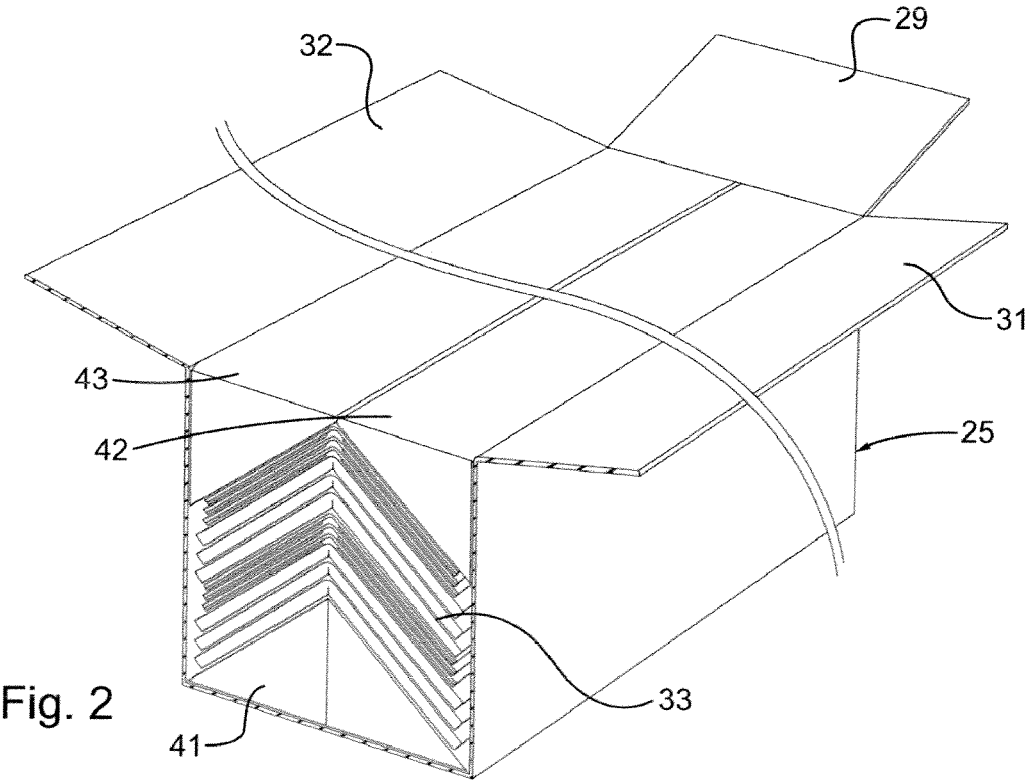
FIG. 2 is perspective view of the container, stack of shingles and upper and lower insert structures illustrated in FIG. 1, with the front surface of the container shown broken away, for clarity of illustration of the contents of the container.
Figure 15:
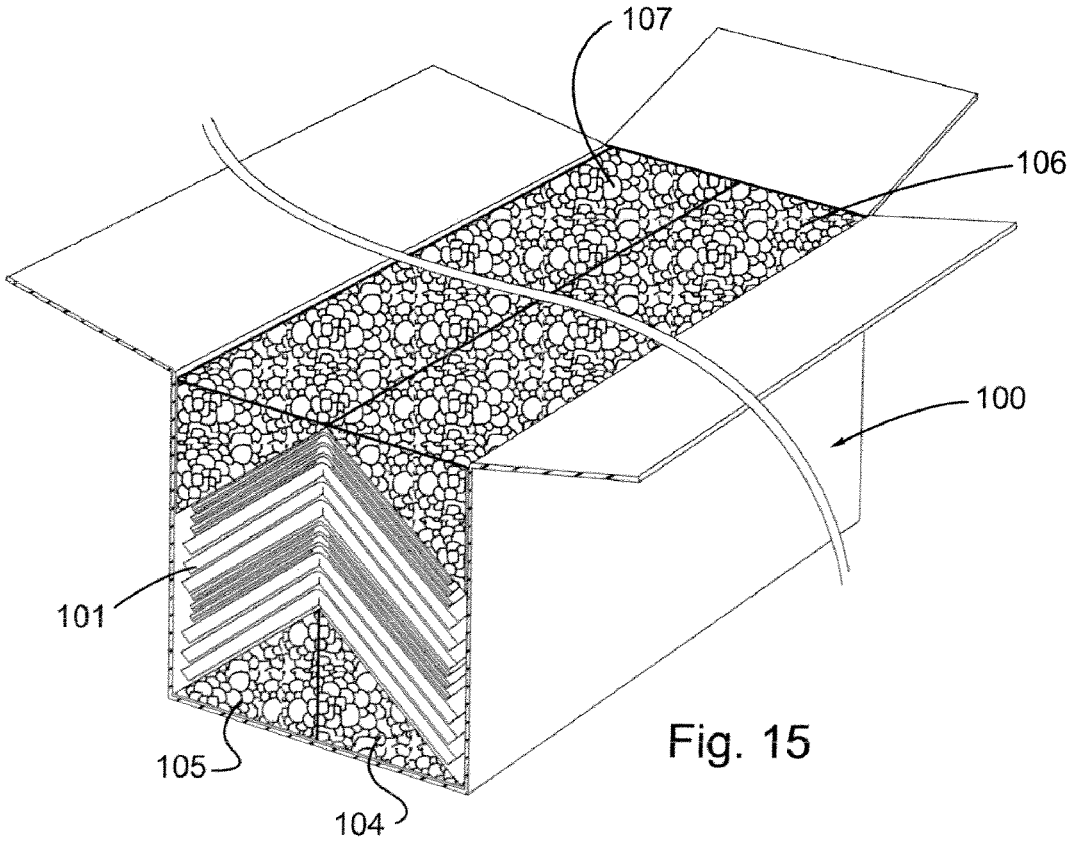

FIG. 15 is an illustration similar to that of FIG. 2, but wherein the insert structures are of cellular foam construction.

Figure 16:
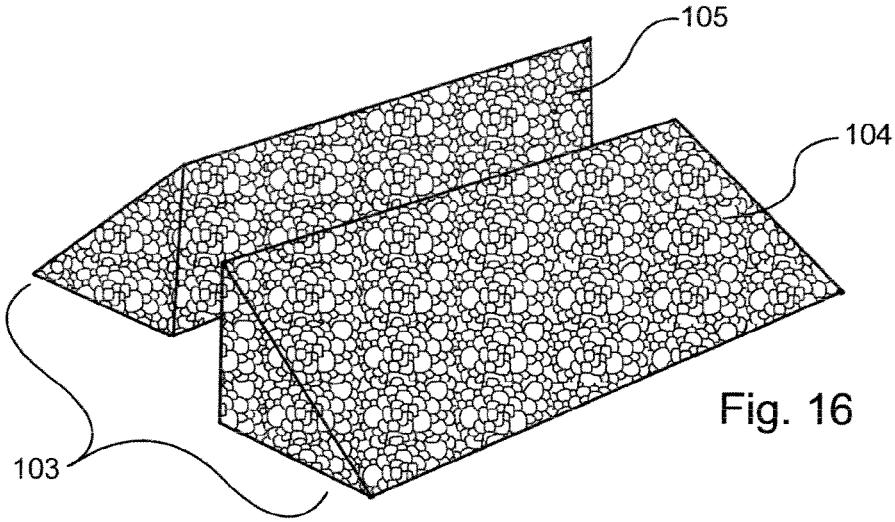

FIG. 16 is a perspective view of a pair of cellular foam components that comprise a lower insert structure for use with the package illustrated in FIGS. 14 and 15.

Figure 17:
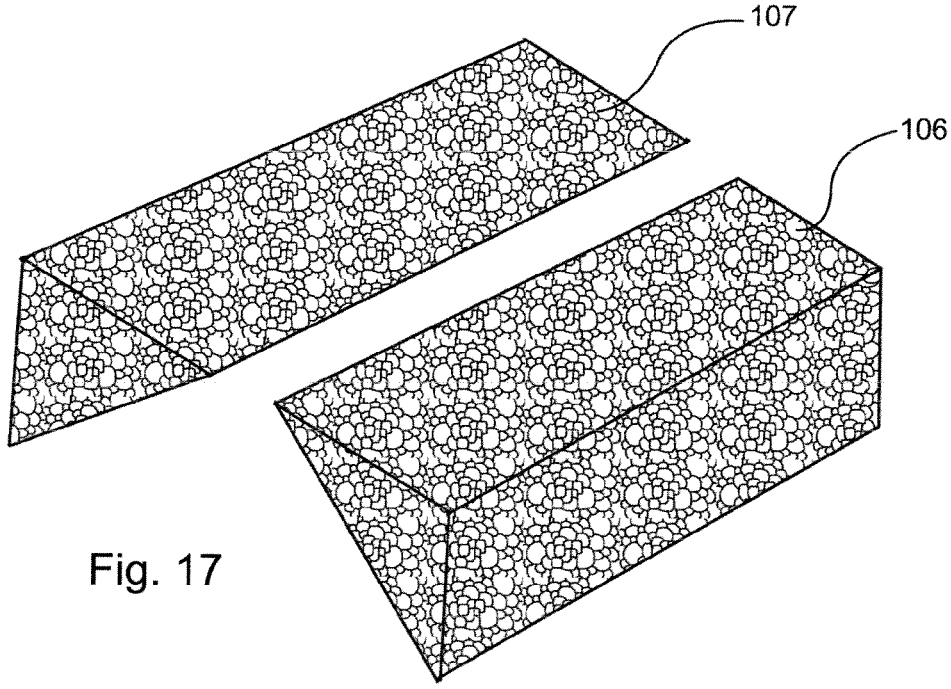

FIG. 17 is a perspective view of a pair of upper insert structures, for use above the stack of shingles illustrated in FIGS. 14 and 15, to fill the upper end of the containers of FIGS. 14 and 15.

Figure 18:
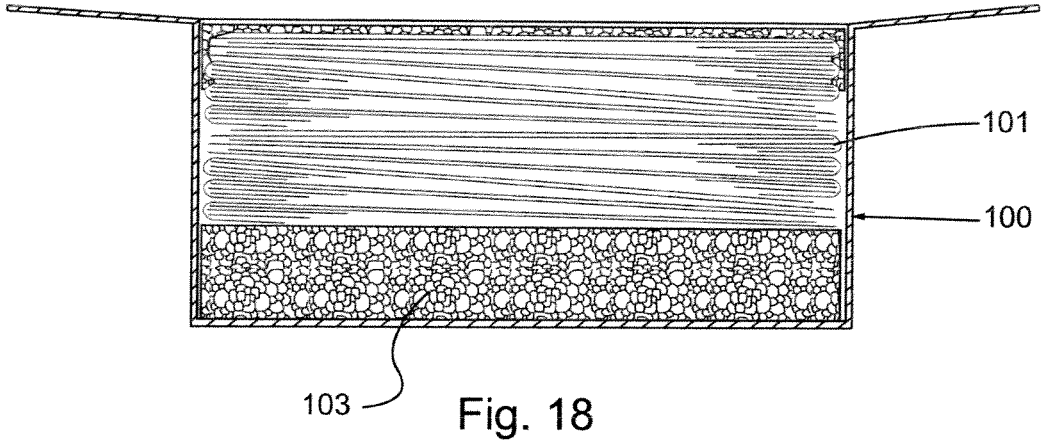

FIG. 18 is an illustration similar to that of FIG. 12, but wherein the upper and lower insert structures are of cellular foam configuration, instead of being of the folded cardboard construction illustrated for FIG. 12.

Figure 19:
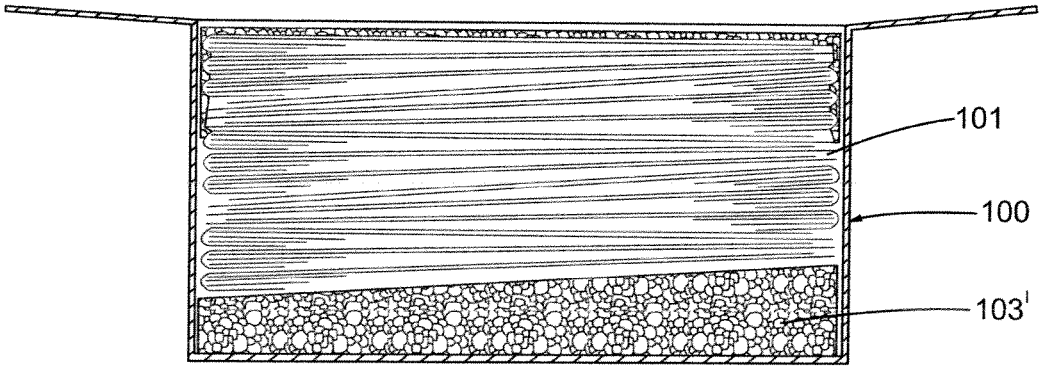

FIG. 19 is an illustration similar to that of FIG. 13, but wherein the upper and lower insert structures are of cellular foam configuration, with the lower insert structure being of prismoid configuration.

Figure 20:
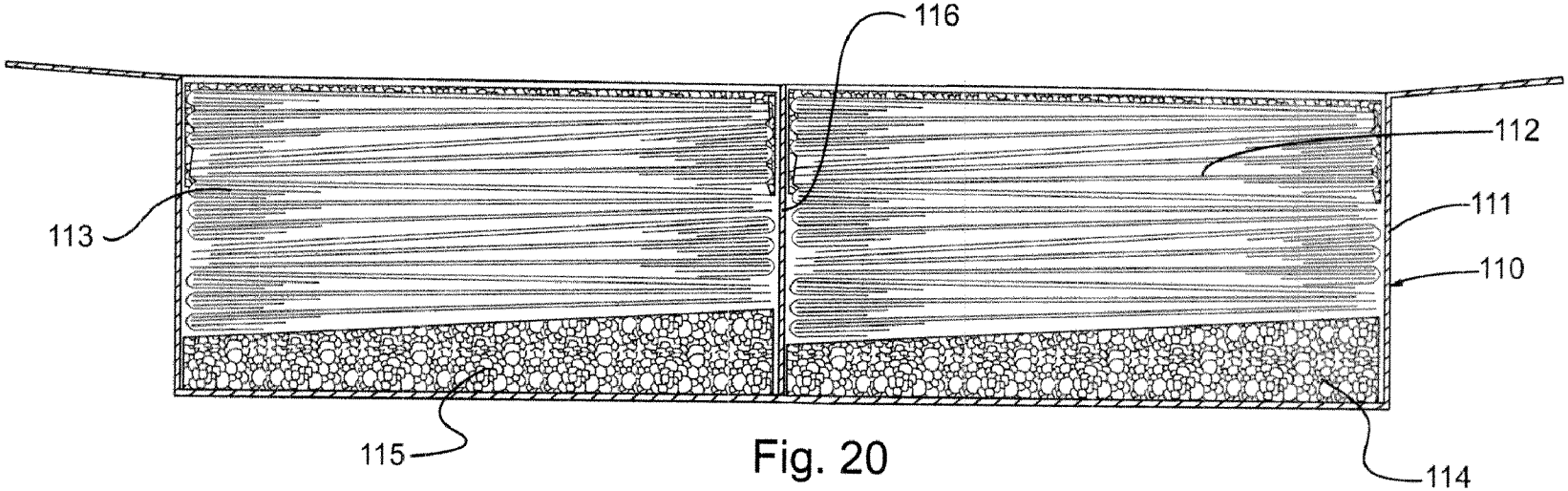

FIG. 20 is a longitudinal sectional view, taken through a container in accordance with this invention, wherein two stacks of shingles are illustrated, with the stacks being arranged end-to-end, and with the insert structures being of cellular foam construction, with the lower insert structures being of prismoid configuration, and with one larger end of a prismoid construction facing toward a smaller end of an adjacent prismoid construction.

Figure 21:
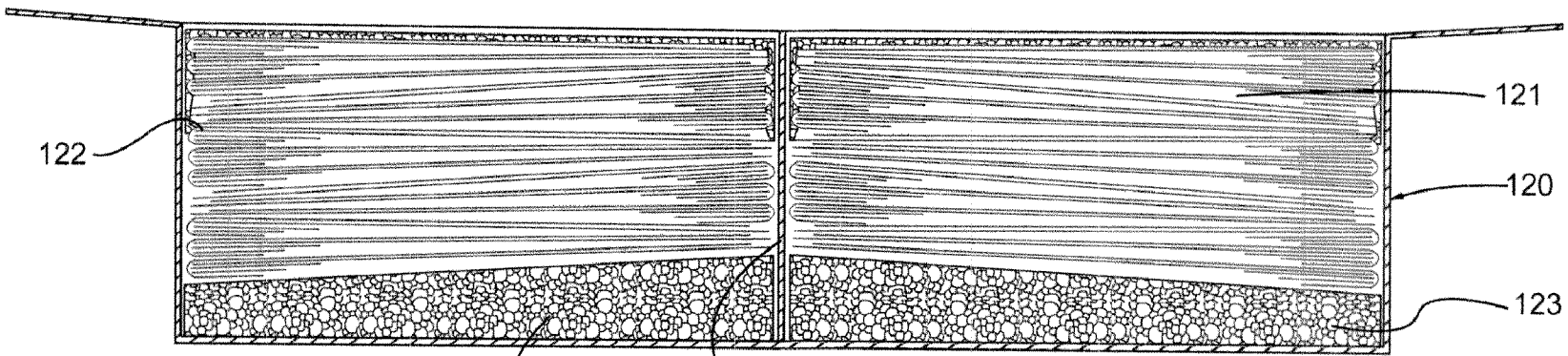

FIG. 21 is a longitudinal sectional view similar to that of FIG. 20, but wherein the insert structures vary in size from one end of each stack to the other, with the lower insert structures being of prismoid construction, with their larger ends facing toward each other.

Figure 22:
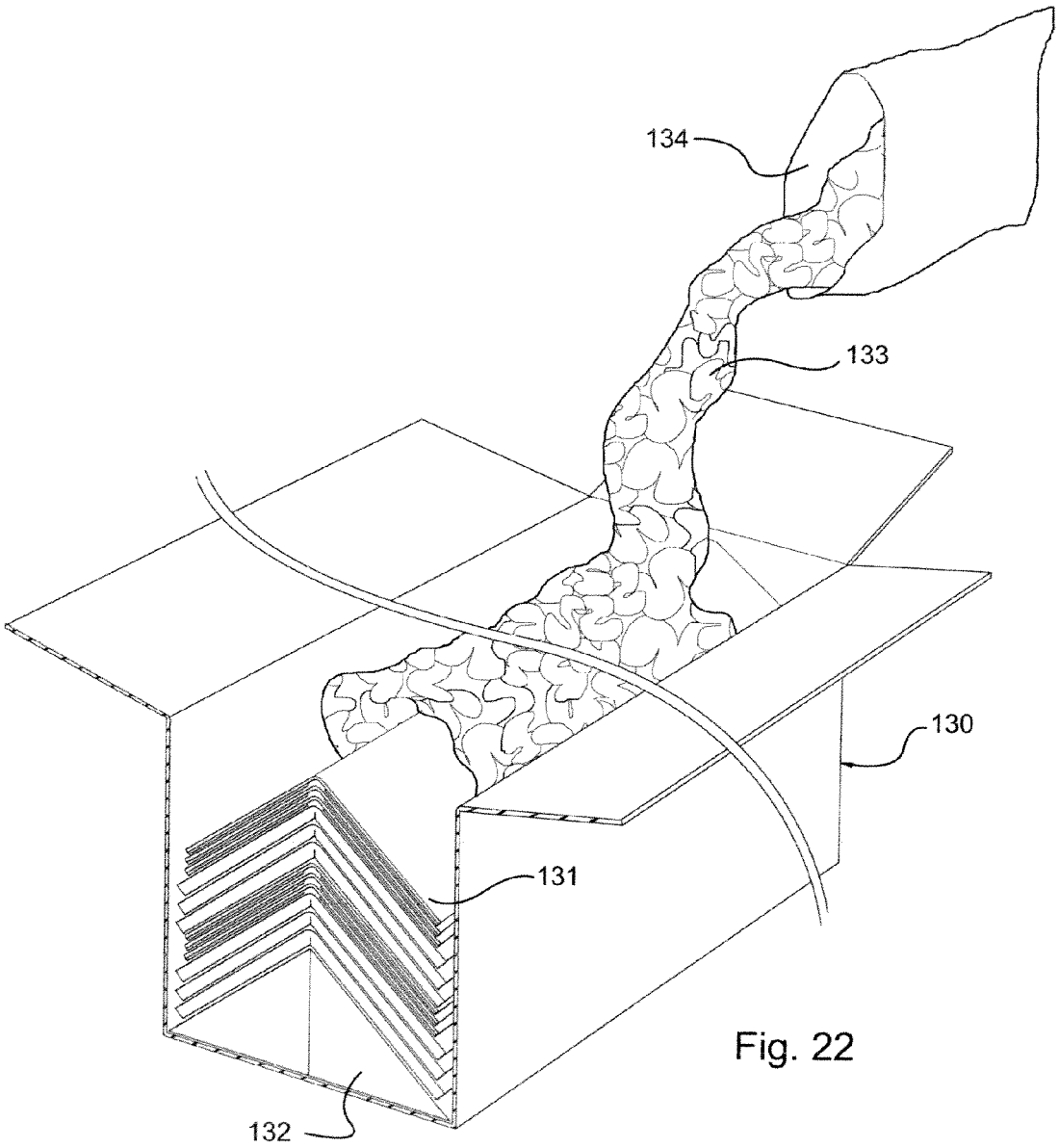

FIG. 22 is a perspective view similar to that of FIG. 2, but wherein the upper insert structure is comprised of a plurality of filler particles being poured into the package, above the shingles.

DETAILED DESCRIPTIONS OF THE PREFERRED EMBODIMENTS

Referring now to the drawings in detail, reference is first made to FIG. 1, wherein the package 25 is generally indicated, as comprising a container 26, having a bottom wall 27 sidewalls 28 and 30, opposite endwalls (unnumbered), and top closure flaps 31 and 32, with the container 26 being preferably of cardboard construction, which can be corrugated cardboard, if desired.

Also in FIG. 1, is a stack 33 of shingles. Each of the shingles 34 in the stack is made to be thicker at one end than the other. That is, each of the shingles has a thicker end that will be visible when the shingle is installed on a roof, preferably in the form of a hip, ridge or rake shingle, and is thinner at its opposite end, which would be the end of the shingle that is partially overlapped by a next-overlying shingle upon installation. Thus, in the arrangement of FIG. 1, the bottom three shingles 35 are shown to be presented with their thicker ends facing the viewer, as shown, with the next three shingles 36 presenting their thinner ends or edges to the viewer as shown in FIG. 1, and with the remaining shingles in the stack continuing to alternate in the same manner, as shown, such that some of the shingles in the stack 33 have thicker ends aligned with thinner ends of other shingles, and with some of the shingles having thicker ends aligned with other thicker ends of other shingles, as shown.

It will also be seen that the shingles in the stack 33 of shingles are pre-folded, each with a pointed apex 37, and with panel portions 38 bent toward each other into a "V"-shaped configuration as shown, with, for example, the lower-most shingle in the stack 33 defining a hollow zone 40 therebeneath of triangular configuration in the transverse direction as shown in FIG. 1.

It will be understood that the hollow zone 40, while being explained in the form of defining a "V"-shaped configuration, but is of selected orientation such that in the embodiment of FIG. 1 is of inverted "V" configuration. However, the disposition of shingles in a container 26 could be of true "V" configuration, or they could be stacked with their thicker end thinner edges facing upwardly or downwardly or sideways as may be desired, depending upon the selected orientation that is chosen upon their being packaged.

With further reference to FIGS. 1 and 2, it will be seen that a bottom insert 41 is shown, of folded cardboard or the like construction, as will be described further, hereinafter. At the top of the container 26, above the stack 33 of shingles, there are provided upper insert structures 42, 43 also in the embodiment of FIG. 1 being preferably of corrugated cardboard construction, folded to desired configurations, as shown and as will be further described herein. Alternative materials suitable for use in the various inserts 41, 42, 43 include paper or plastic based materials that may include virgin materials or recycled components of post-industrial or post-consumer origin.

With reference to FIG. 2, the package 25 is likewise illustrated in perspective, with a stack 33 of shingles disposed therein, as described above with respect to FIG. 1, with a lower insert structure 41, and with upper insert structures 42 and 43, also as described with respect to FIG. 1, and with folded flaps 29, 31, 32 adapted to close the package upon it being filled. It will be understood that an end flap opposite that 29 is also provided, but is not shown to allow the expedient of having the cross-sectional illustration for the left end of the package 25 with end view broken away as indicated for the sake of clarity.

Figure 3:
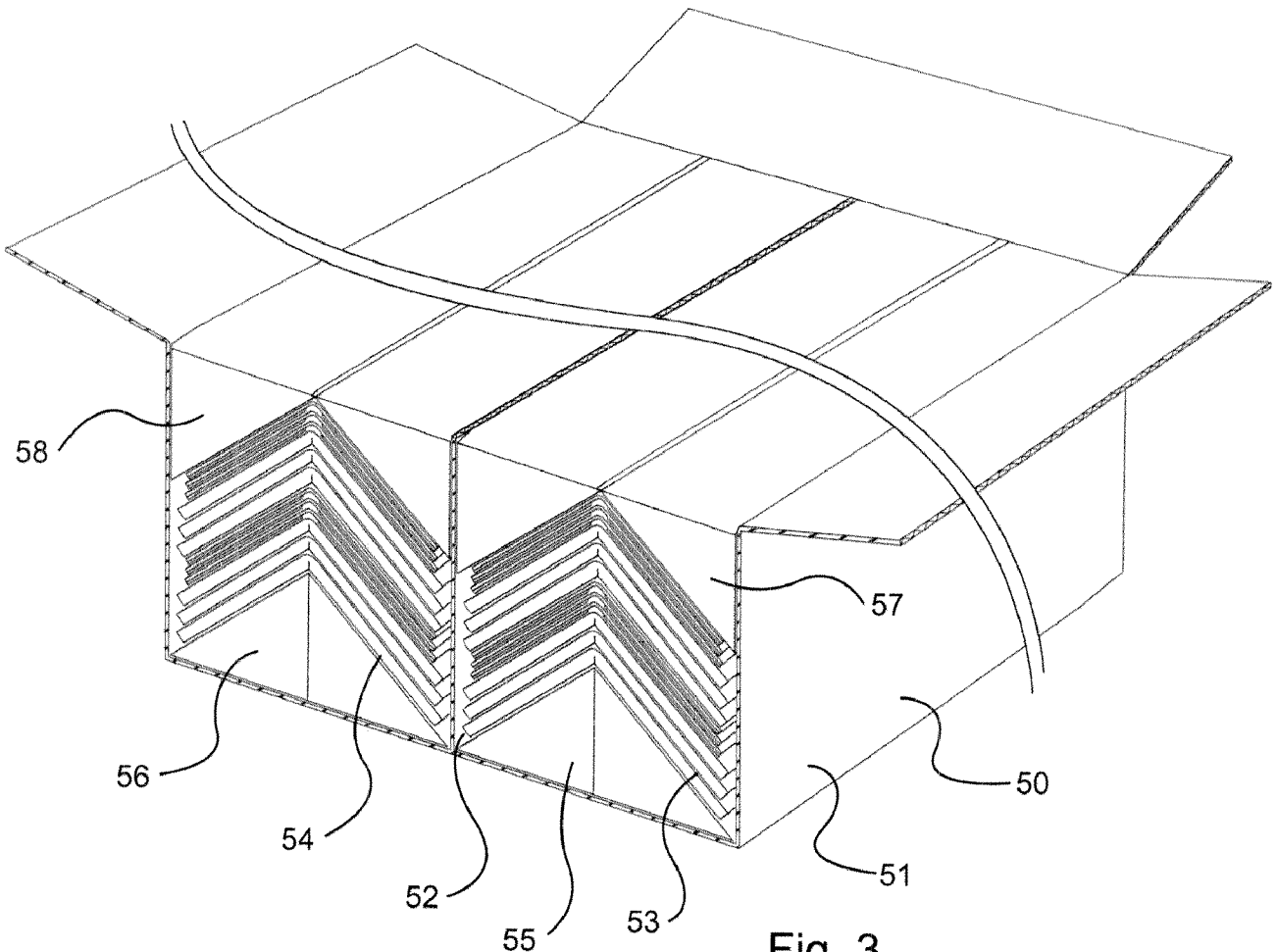
FIG. 3 is a perspective view, similar to that of FIG. 2, but wherein a pair of stacks of shingles, with their lower supporting insert structures and upper insert structures disposed above the stacks of shingles, with the stacks in side-by-side relation.

With reference to FIG. 3, an alternative package 50 is shown, likewise illustrated as being fragmentally broken away, to yield a package of indeterminate length, as is the illustration of FIG. 2, but wherein for the package 50, the container 51 is provided with a longitudinally disposed separating wall 52, separating two stacks 53 and 54 of shingles, and beneath each stack is a folded cardboard or the like insert structure 55, 56.

Above the stacks 53 and 54 of shingles inside the container 51, are shown two pairs of upper insert structures 57 and 58, each of two-piece construction and each being of triangular configuration in transverse section, as are the insert structures 55 and 56, and each extending longitudinally, as shown in FIG. 3. The divider 52 separates the two stacks of shingles 53, 54 as shown.

Figure 4:
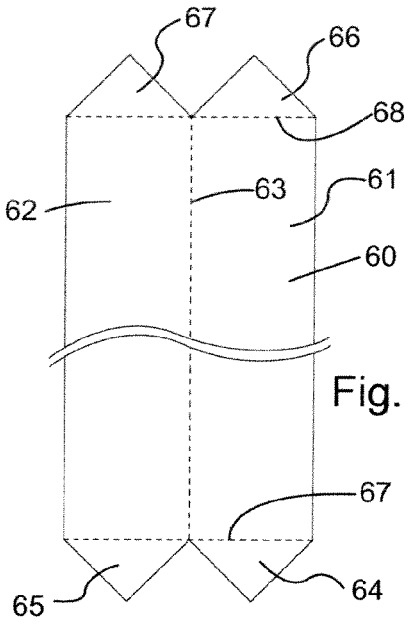
FIG. 4 is a plan or layout illustration of a flat, generally cardboard blank prior to it being folded along the fold lines for formation of a three-dimensional insert structure in accordance with this invention.

With reference to FIG. 4, a blank of foldable cardboard or like material 60 is provided, for forming any of the lower insert structures 41, 55, 56. The blank 60 is likewise shown to be of indeterminate length by the drafting expedient separating the upper and lower portions thereof as shown in FIG. 4.

The blank 60 is shown as having two generally planar surface legs 61 and 62, foldably connected along longitudinal fold line 63, and with triangular support panels 64, 65, 66 and 67, for forming triangular supports, connected to the planar surface leg portions of the blank 60, along fold lines 67 and 68, at spaced-apart opposite ends of the blank 60 as shown.

Figure 5:
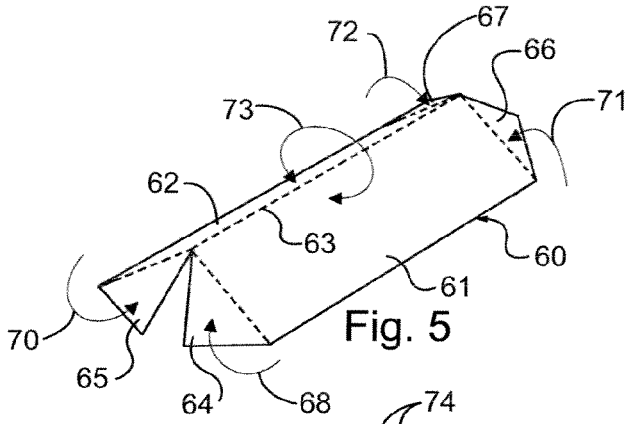
FIG. 5 is an illustration of the blank of FIG. 4, partially folded along the dotted fold lines, in the directions indicated by the arrows, approaching the formation of a three-dimensional insert structure.
Figure 6:
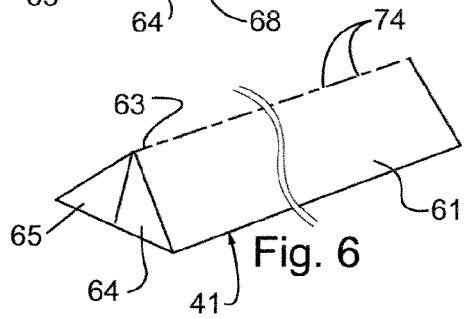
FIG. 6 is a three-dimensional insert structure in accordance with this invention, made as illustrated in FIGS. 4 and 5.

With reference now to FIG. 5, it will be seen that the end panels 64-67 can be folded inwardly, in the directions indicated by the arrows 68, 70, 71 and 72, and as the planar surface legs 61 and 62 are folded along the longitudinal fold line 63, as indicated by the arrow 73, the blank 60 will be folded into the configuration therefor illustrated in FIG. 6, to form an insert structure having planar surface legs 61 and 62, foldably connected to each other along fold line 63, with triangular supports being formed at the spaced-apart opposite longitudinal ends thereof by means of inwardly folded ends such as those 64 and 65, supporting the planar surface legs 61 and 62, at the interior of the insert structure 41 thus formed. It will also be understood that the fold line 63 may, if desired, be a line having pre-formed perforations 74, if desired, for ready separation of an insert structure 41, into two halves, to each form upper insert structures 42, 43, for disposition inside the container 25 above the stack of shingles disposed therein, to fill the spaces above the uppermost shingles in the stack 33, if desired.

Figure 7:
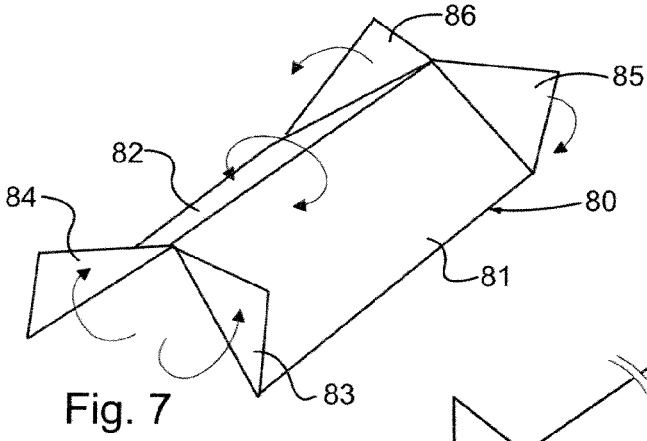
FIG. 7 is a partially folded alternate formation of an insert structure, from the blank illustrated in FIG. 4.
Figure 8:
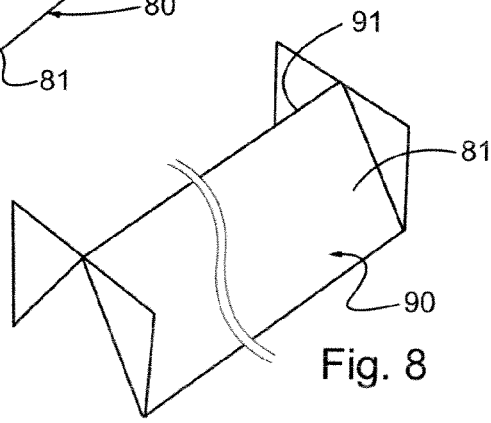
FIG. 8 is a completed form of insert structure made from the blank illustrated in FIG. 4, based upon the folds of the various portions thereof as illustrated in FIG. 7.

With reference now to FIG. 7, it will be seen that an alternative form of insert structure 80 is provided, that may likewise be formed from the blank 60 of FIG. 4, but wherein, as the planar surface legs 81 and 82 are folded to form a "V" configuration of desired orientation, as shown, the panels 83, 84, 85 and 86 at the ends can be folded upwardly as shown in FIG. 7, rather than downwardly as shown in FIG. 5, to yield triangular supports connected to the planar surface legs 81 and 82 at spaced-apart opposite ends, in the form of an insert structure 90, as illustrated in FIG. 8, such that the planar surface legs 81 and 82 are supported in a different manner than is provided by the spaced-apart triangular supports at the opposite ends of the insert structure shown in FIG. 6. While the fold line 91 for an insert structure 90 is not shown in perforated form, for ready separation into two separate upper insert structures for disposition above a stack of shingles in the package, it will be understood that the fold line 91 could be of the perforated type as may be desired.

Figure 9:
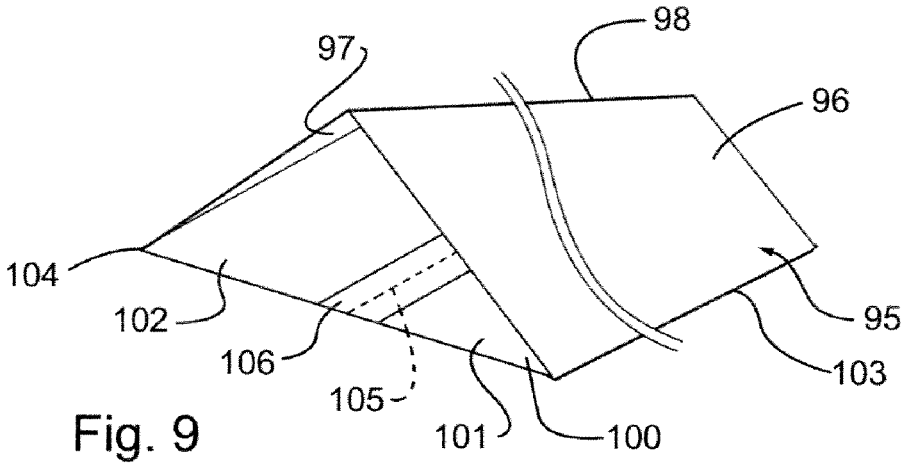
FIG. 9 is yet another perspective view of an alternative form of insert structure in accordance with this invention.

With reference now to FIG. 9, an alternative structure 95 is illustrated, as being comprised of planar surface legs 96, 97, folded about fold line 98, and wherein the same are supported by a supporting planar surface 100 that has a pair of panels 101 and 102, foldably connected to the planar surface legs 96, 97, along fold lines 103 and 104, respectively, and wherein the longitudinal edges of the panels 101 and 102 are joined at 105, and secured together by an overlying tape 106, to yield a closed triangular configuration, as shown, with the taped-together panels 101 and 102 forming essentially a third planar surface leg of the triangular configuration shown for the insert 95 of FIG. 9. As an alternative to a tape 106 for securing the panels 101 and 102 at 105, an adhesive lap joint or mechanical interlock structure could be used to secure the panels together.

With reference to FIG. 10, a further alternative embodiment for the insert structure is shown, generally designated the numeral 110, and comprising two generally planar surface legs 111 and 112, connected together along fold line 113, which can, if desired, be a pre-perforated fold line as described above, and wherein interior supports 114 and 115 are foldably connected to respective panels 116 and 117, that in turn are connected to the planar surface legs 111 and 112, along respective fold lines 118 and 120, with the supports 114 and 115 having their upper ends 121 and 122 supporting against the upper inside surfaces of the planar supporting legs 111 and 112, as shown, for providing rigidity to the three-dimensional triangular insert structure 110, as shown.

Figure 11:
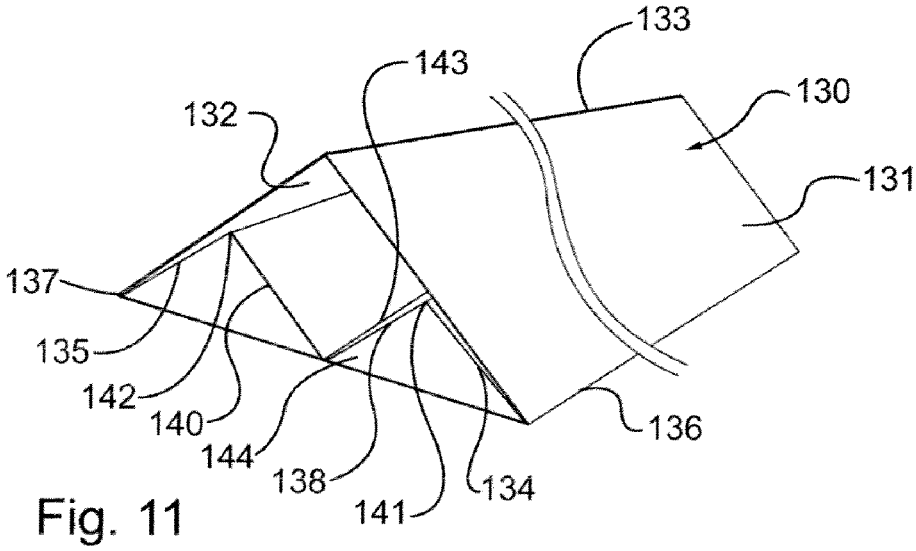
FIG. 11 is a perspective view of yet another alternative form of insert structure in accordance with this invention.

FIG. 11 shows a further embodiment for the insert structure, being generally designated 130, as shown, and also comprising a generally triangular configuration in the transverse direction between its spaced-apart ends and presenting two generally planar surface legs 131 and 132 connected together along fold line 133. An additional bottom panel 144 may extend between fold lines 136 and 137, connected to the planar surface legs 131, 132, as with the embodiment of FIG. 9, for additional rigidifying support for the insert structure, at the interior thereof. Additional interior supports are provided by longitudinally disposed panels 134 and 135, which are then foldably connected to additional panels 138 and 140 along fold lines 141 and 142, to meet at a longitudinal fold line 143 formed between edges of the panels 138 and 140.

With reference to FIG. 12, the stack 33 of shingles disposed within the container 26 is illustrated, supported by the folded cardboard insert 41 at the bottom thereof, as shown. It will be seen that the bottom three shingles 35 have their thicker edges on the left side of the sectional illustration of FIG. 12, with the next three shingles having their thinner edges disposed thereabove, with their thicker edges toward the right end wall, as shown, and with the shingles in the stack then progressing in an alternating manner with some thicker edges of shingles to the left, followed by shingles with their thicker edges to the right, as shown. It will be understood that the insert structure 41 is constructed to be of uniform vertical dimension from the package bottom 27, as shown, up to the apex or fold line 63 for the insert as shown in FIG. 5 disposed therein, such that the insert is therefor of the construction of a prism of three longitudinal sides, as shown.

In distinction to this, with reference to FIG. 13, it will be seen that the insert 41', is of prismoid construction, such that its fold line 63' is at an angle "a" as shown, so that it varies in vertical dimension from left-to-right, even though it is of triangular cross-sectional configuration, to be of prismoid construction of three longitudinal sides, as shown.

Thus, as used herein, an insert such as that 41 will be considered to be of prism construction, whereas an insert like that 41', in its shape, is considered to be of prismoid construction.

Also, with reference to FIG. 13, it will be seen that, for a give grouping of shingles in a stack, a thicker group of, for example, three shingles, will be of a dimension "D", as shown at their thick ends, and at their thinner ends or edges, will be of a dimension D' as shown, lesser than the dimension "D".

With reference to FIG. 14, a package 100 of shingles 101, in a container 102 is provided, all of which is similar to the container and shingles of FIG. 1, so the details thereof need not be described further herein. However, in the embodiment of FIG. 14, the insert structure 103 is of cellular foam construction, and may be of one piece, or of two pieces as shown for example in FIG. 16, in which case, the insert structure at the bottom of the container 102 is comprised of two separate cellular foam elements 104 and 105, for supporting the end-most (lowermost) shingle in the stack as shown in FIG. 14, in the same manner that the insert structure 41 supports the lowermost shingle in the stack illustrated in FIG. 1.

In FIG. 14, and in the perspective view of FIG. 15, it will also be seen that cellular foam upper insert structures 106 and 107 are provided, for filling the triangular spaces on opposite sides of the fold line of the uppermost shingle in the stack of shingles, to yield a full package when the closing flaps of the container are folded over in the closed configuration to inhibit movement of shingles within the package.

The upper insert structures 106 and 107 are illustrated in perspective form, showing greater detail, in FIG. 17.

FIG. 18 is similar to the illustration of FIG. 12, so the details thereof will not be substantially repeated herein. However, in FIG. 18, the bottom insert structure is of cellular foam construction, as described above with respect to FIGS. 14-16, with the lower insert structure being of prism configuration, uniform in size along its longitudinal length, as shown.

With reference to FIG. 19, the illustration is similar to that of FIG. 13, but wherein the bottom insert structure 103' is of prismoid configuration, while also being of cellular foam construction.

Referring now to FIG. 20 another embodiment 110 is shown for the package of specialty roofing materials, as comprising a container 111, having two longitudinally spaced-apart stacks 112, 113 of shingles, each arranged as shown with respect to the embodiment of FIG. 18, but where the two stacks 112, 113 are longitudinally disposed, end-to-end, and with each bottom insert structure 114, 115, being of cellular foam construction and of prismoid configuration, with shorter prismoid ends to the left.

In FIG. 21, an illustration somewhat similar to that of FIG. 20 is provided for a package 120 of shingles, having a pair of stacks 121 and 122 of shingles with their thicker and thinner edges likewise alternating, as shown, but wherein the insert structures 123, 124 for providing bottom support, while being of prismoid configuration each, are disposed with their larger ends facing toward each other. In an alternative embodiment (not shown), insert structures 123, 124, could be disposed with their larger ends facing away from one another.

In each of the embodiments of FIGS. 20 and 21, a vertical separation panel 116 or 125 is provided, to provide end-wise separation of the stacks of shingles.

With reference to FIG. 22, another embodiment 130 is shown for a package of shingles 131, with a bottom insert structure 132 provided. It will be understood that the shingles in the stack 131 can be similar to any of those set forth above, with respect to any of the embodiments described above. In the illustration of FIG. 22, the insert structure is similar to that set forth in 1, 2 and 6, for example, although the same could be in the form of any of the bottom insert structures described above. In the embodiment of FIG. 22, an alternative type of filler is provided above the uppermost shingle in the stack, in the form of a plurality of filler particles, sometimes referred to as "packaging peanuts" 133 filling the upper end of the container above the shingles, and being provided from a suitable dispensing bag 134 or the like.

It will thus be apparent from the forgoing that various modifications may be made in the details of construction, in the orientation of shingles within a container, in the materials used for constructing the inserts, as well as in variations in construction for the shingles themselves that comprise the package, all within the spirit and scope of the invention as defined in the appended claims.

What is claimed is:

1. A package of specialty roofing materials comprising:

(a) a plurality of shingles arranged in nested relation, one against another in a stack, with the stack having opposite ends and having endmost shingles at opposite ends of the stack, with the shingles each being:

(i) of variable thickness in a longitudinal direction, from a thicker edge to an opposite thinner edge; and (ii) pre-folded to comprise two shingle panel portions folded about a common connecting longitudinally disposed fold line such that the two panel portions are at angular planes to each other, and such that, in a transverse direction relative to said fold line the shingles each substantially define a V-shaped configuration of selected orientation, with the an endmost folded shingle in the stack having a substantially hollow zone therein, which, in a transverse direction relative to its fold line is of V-shaped configuration;

(b) at least one insert structure disposed against an endmost shingle in the stack, with the at least one insert structure having longitudinally spaced-apart ends and being of generally triangular configuration in the transverse direction between its said spaced-apart ends and presenting two generally planar surface legs of the at least one insert structure against said panel portions and supporting said panel portions of the endmost shingle in its said hollow zone;

(c) said at least one insert structure including a support for maintaining the shape of the at least one insert structure; said support being any one of:

(i) at least one triangular support connected to said planar surface legs at said spaced-apart ends;

(ii) at least one support interior of said at least one insert structure, supporting said planar surface legs;

(iii) a supporting planar surface connecting the generally planar surface legs to comprise a third planar surface leg of said triangular configuration; and (iv) a substantially solid three-dimensional foam support in said hollow zone of said endmost shingle; and (d) a container in which said stack of shingles and said at least one insert structure are disposed.

2. The package of claim 1, wherein the shingles are arranged in the stack with some thicker shingle edges alternately aligned with some thinner shingle edges and with some other thicker shingle edges.

3. The package of claim 1, wherein a said insert structure is in the shape of a longitudinal prism between its spaced-apart ends.

4. The package of claim 1, wherein a said insert structure is in the shape of a longitudinal prismoid between its spaced-apart ends.

5. The package of claim 1, wherein a said insert structure is of folded cardboard construction.

6. The package of claim 1, wherein a said insert structure is of cellular foam construction.

7. The package of claim 1, wherein the said at least one insert structure is a lower insert structure, disposed below the stack of shingles in the package, and wherein at least one upper insert structure is provided, in the package, above the stack of shingles, for filling spaces in the package, above the shingles.

8. The package of claim 7, wherein said at least one upper insert structure is comprised of two pieces made from an additional lower insert structure that is longitudinally severable into two generally triangular shaped components in the transverse direction for filling spaces of generally triangular configuration in the transverse direction in the package, above the shingles.

9. The package of claim 7, wherein the at least one upper insert structure is comprised of a plurality of filler particles in the package above the shingles.

10. The package of claim 1, wherein there are a plurality of laterally arranged, side-by-side stacks of shingles and insert structures in said container.

11. The package of claim 1, wherein there are a plurality of longitudinally arranged, end-to-end stacks of shingles and insert structures in said container.

12. An insert structure for disposition in a package of specialty roofing shingles that are arranged in nested relation, one against another in a stack with the stack having opposite ends and having endmost shingles at opposite ends of the stack, with the insert structure being adapted to be disposed against an endmost shingle in the stack:

(a) the insert structure having longitudinally spaced-apart ends and being of generally triangular configuration between its said spaced-apart ends and presenting two generally planar surface legs of the insert structure for disposition against pre-folded panel portions of an endmost shingle in the stack for supporting said panel portions of an endmost shingle in a substantially V-shaped configuration of a hollow zone of selected orientation between said panel portions of an endmost shingle;

(b) said insert structure including a support for maintaining the shape of the insert structure; said support being any one of (i) at least one triangular support connected to said planar surface legs at said spaced-apart opposite ends;

(ii) at least one support interior of said insert structure, supporting said planar surface legs;

(iii) a supporting planar surface connecting the planar surface legs to comprise a third planar surface leg of said triangular configuration; and (iv) a substantially solid three-dimensional foam support for placement in a hollow zone beneath a said endmost shingle in the stack.

13. The insert structure of claim 12, wherein said insert structure is in the shape of a longitudinal prism between its spaced-apart ends.

14. The insert structure of claim 12, wherein said insert structure is in the shape of a longitudinal prismoid between its spaced-apart ends.

15. The insert structure of claim 12, wherein said insert structure is of folded cardboard construction.

16. The insert structure of claim 12, wherein said insert structure is of cellular foam construction.

17. The insert structure of claim 12, wherein the insert structure has a predetermined severance line and is longitudinally severable along said severance line into two generally triangular shaped components in the transverse direction, for use in filling spaces of generally triangular configuration in the transverse direction in a package of shingles and above the shingles in the package.

18. A method of packaging of specialty roofing materials comprising:

(a) providing a plurality of shingles arranged in nested relation, one against another in a stack with the stack having opposite ends and having endmost shingles at opposite ends of the stack, with the shingles each being:

(i) of variable thickness in a longitudinal direction, from a thicker edge to an opposite thinner edge; and (ii) pre-folding each shingle to comprise two shingle panel portions folded about a common connecting longitudinally disposed fold line such that the two panel portions are at angular planes to each other, and such that, in a transverse direction relative to said fold line they each substantially define a V-shaped configuration of selected orientation, with the an endmost folded shingle in the stack having a substantially hollow zone therein, which, in said transverse direction is of V-shaped configuration;

(b) disposing at least one insert structure against a said endmost shingle in the stack, with the said at least one insert structure having longitudinally spaced-apart ends and being of generally triangular configuration in said transverse direction between its said spaced-apart ends so that the said at least one insert structure presents two generally planar surface legs of the at least one insert structure against said panel portions, supporting said panel portions of the endmost shingle in its said hollow zone;

(c) providing support for the at least one insert structure for maintaining the shape of the insert at least one structure; with the step of providing support being any one of:

(i) providing at least one triangular support connected to said planar surface legs at said spaced-apart opposite ends;

(ii) providing at least one support interior of said at least one insert structure, supporting said planar surface legs;

(iii) providing a supporting planar surface connecting the generally planar surface legs to comprise a third planar surface leg of said triangular configuration; and (iv) providing a substantially solid three-dimensional foam support in said hollow zone of said endmost shingle; and (d) placing said stack of shingles and said at least one insert structure into a container.

* * * * *